US006780037B1

(12) United States Patent
Parmeter et al.

(10) Patent No.: US 6,780,037 B1
(45) Date of Patent: Aug. 24, 2004

(54) DEBRIS SEAL FOR ELECTRICAL CONNECTORS OF PUMP MOTORS

(75) Inventors: Larry J. Parmeter, Broken Arrow, OK (US); Brett D. Leamy, Claremore, OK (US); Clarence F. Hall, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/680,699

(22) Filed: Oct. 7, 2003

(51) Int. Cl.[7] ..... H01R 4/60

(52) U.S. Cl. ..... 439/191; 439/271; 439/274; 439/926

(58) Field of Search ..... 439/271, 274–276, 439/190–191, 926

(56) References Cited

U.S. PATENT DOCUMENTS

| | | | | |
|---|---|---|---|---|
| 2,359,215 A | | 9/1944 | Gold | |
| 3,604,964 A | | 9/1971 | Davenport et al. | |
| 4,227,043 A | | 10/1980 | Stöhr et al. | |
| 4,350,911 A | | 9/1982 | Wilson et al. | |
| 4,409,504 A | | 10/1983 | Wilson et al. | |
| 4,513,215 A | | 4/1985 | Del Serra | |
| 4,549,105 A | | 10/1985 | Yamamoto et al. | |
| 4,578,608 A | | 3/1986 | Mech et al. | |
| 4,599,487 A | | 7/1986 | Blank et al. | |
| 4,626,721 A | | 12/1986 | Ouchi | |
| 4,682,847 A | * | 7/1987 | Moore et al. | 439/271 |
| 4,857,006 A | | 8/1989 | Linyeav et al. | |
| 5,113,101 A | | 5/1992 | Liu et al. | |
| 5,221,214 A | | 6/1993 | Martin | |
| 5,358,418 A | * | 10/1994 | Carmichael | 439/190 |
| 5,941,695 A | | 8/1999 | Jensen et al. | |
| 6,179,585 B1 | | 1/2001 | Kobylinski et al. | |
| 6,409,485 B1 | | 6/2002 | Ebner | |
| 6,435,756 B1 | * | 8/2002 | Robin et al. | 403/221 |
| 6,443,780 B2 | | 9/2002 | Wilbourn et al. | |
| 6,623,289 B2 | * | 9/2003 | Decicco | 439/271 |

* cited by examiner

*Primary Examiner*—Truc Nguyen
(74) *Attorney, Agent, or Firm*—Bracewell & Patterson, L.L.P.

(57) ABSTRACT

A motor assembly has electrical connectors between them that are shielded from any metallic debris generated in the motors. The motor assembly includes upper and lower motors, each having an adapter coupled together. Each adapter has a wire passage for each phase of the motor. Wires from the motors join electrical connectors, the electrical connectors being mounted to insulators in the adapter passages. A debris seal locates above the upper electrical connector in each upper adapter passage. Another debris seal locates between the overlapping portions of the two insulators of each adapter passage.

21 Claims, 3 Drawing Sheets

DEBRIS SEAL FOR ELECTRICAL CONNECTORS OF PUMP MOTORS

FIELD OF THE INVENTION

This invention relates in general to electrical submersible well pump motors, and in particular to debris seals to protect electrical connectors.

BACKGROUND OF THE INVENTION

Electrical submersible well pumps are often employed in low pressure oil wells that produce large amounts of water along with the oil. The pump assembly is typically suspended on a string of production tubing within casing. Normally, the pump is located at the upper end of the assembly and connects to an electrical motor assembly at the lower end of the pump. A seal section locates between the motor and the pump for equalizing the pressure of dielectric liquid in the motor with hydrostatic pressure in the well.

An electrical connection receptacle is located near the upper end of the motor. A power cable extends from the surface into the well. The power cable has a motor lead on its lower end that releasably connects to the receptacle. In some cases, due to the size of the pump, tandem motors will be used. The upper tandem motor has a base or adapter on its lower end that connects to an adapter on the upper end of the lower tandem motor. Wires from the upper tandem motor lead to electrical connectors in the adapter of the upper tandem motor. These electrical connectors engage electrical connectors on the upper end of the lower motor. The motors are filled with the dielectric liquid or lubricant, and the interiors of the motors are in fluid communication with each other.

Submersible motors typically use bronze bushings and bearing sleeves that produce metallic debris from normal wear over time. Metallic debris will sometimes migrate through the dielectric oil and lodge around and inside the open spaces of the electrical connectors. This can cause a phase-to-phase or phase to-to-ground short, thus destroying the motors. Also, it is possible for small amounts of water or moisture to migrate to the electrical connectors, creating a short.

SUMMARY OF THE INVENTION

The motor assembly of this invention has an electrical connector assembly with an insulator having a passage. An electrical conductor having an insulation layer on its exterior extends extending from the motor into the passage of the insulator. The passage has an inner diameter that is larger than an outer diameter of the insulation layer, defining an annular cavity between the insulation layer and the inner diameter of the passage. An electrical connector is joined to the electrical conductor within the passage.

An elastomeric debris seal is positioned around the insulation layer. The debris seal has a final size in which it seals around the insulation layer and blocks entry of debris into the annular cavity. The debris seal is of a material that swells upon contact with a dielectric fluid and has an having an initial size in which it does not seal the annular cavity to enable the dielectric fluid to flow into the annular cavity prior to the debris seal reaching the final size.

The operator fills the motor by drawing a vacuum, then introducing dielectric oil. The dielectric oil initially flows past the debris seal to fill the annular cavity surrounding the insulation layer. Then over time, the seal will swell to seal the cavity to prevent the entry of debris.

In the embodiment shown, the motor assembly is a tandem motor assembly. The upper tandem motor has a plurality of wires that extend downward to upper electrical connectors in an upper adapter. Similarly, the lower motor has wires that extend upward to lower electrical connectors at the upper end of a lower adapter. An elastomeric debris seal locates in the upper adapter passage that surrounds each wire. The upper adapter debris seal seals around the upper wire in each upper adapter passage to prevent debris from collecting around the upper electrical connector.

In the preferred embodiment, each adapter wire passage has an insulator located within it. The insulator in the upper adapter passage has one of the debris seals located above it to prevent entry of debris between the inner diameter of the insulator and the wire. The insulator of the lower adapter electrical connector engages the insulator of the upper adapter in a sliding overlapping engagement. Another debris seal locates in the overlapping walls of the insulators. This debris seal prevents debris from migrating into contact with the electrical connectors of the lower motor.

DETAILED DESCRIPTION OF THE PREFERRED EMBODIMENT

Figure 1:
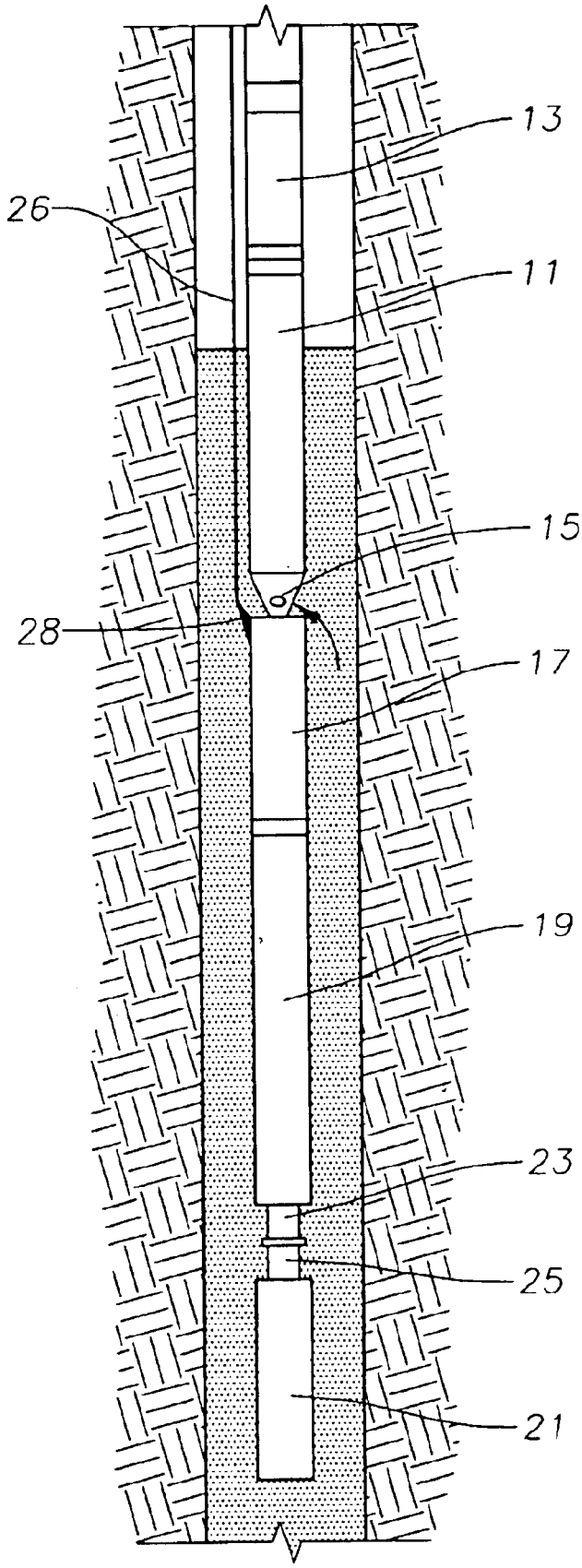
FIG. 1 is a schematic elevational view illustrating an electrical submersible pump installation constructed in accordance with this invention.

Referring to FIG. 1, a well pump assembly in accordance with this invention is shown installed in a well. The well pump assembly includes a pump 11, which may be made up of one or more pump modules. Pump 11 is secured to the lower end of a string of production tubing 13. Pump 11 has an intake 15 at its lower end for drawing in well fluid.

A seal section 17 connects between pump 11 and an upper motor 19 of a tandem motor assembly. A lower motor 21 is secured to upper motor 19. Seal section 17 reduces the pressure differential between the pressure of dielectric oil contained in motors 19, 21 and the exterior hydrostatic pressure of the well fluid. Upper motor 19 has an upper adapter 23 on its lower end that secures to a lower adapter 25 on the upper end of lower motor 21. A power cable 26 extends from the surface alongside tubing 13. Power cable 26 has a motor lead on its lower end that plugs into an electrical receptacle 28 near the upper end of upper motor 19.

Figure 2:
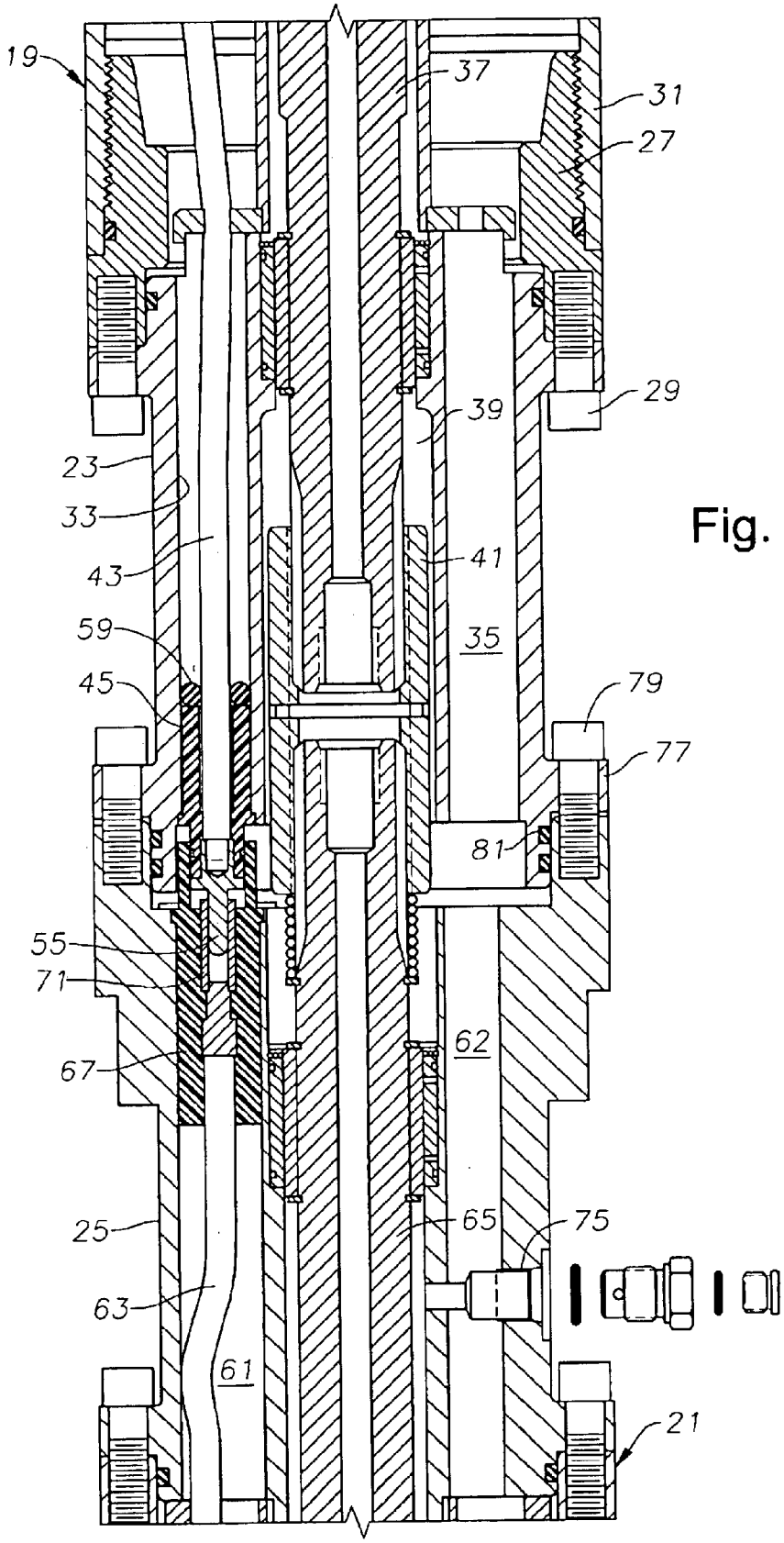
FIG. 2 is an enlarged sectional view of the adapters of the tandem pump motors of FIG. 1.

Referring to FIG. 2, upper adapter 23 may be secured to upper motor 19 in a variety of ways. In this example, a threaded sleeve 27 secures to internal threads in housing 31 of upper motor 19. Upper adapter 23 is mounted to sleeve 27 by bolts 29. Upper adapter 23 has a plurality of wire passages 33 (only one shown). Upper adapter 23 also has at least one communication passage 35 that communicates oil in the interior of upper motor 19 with oil in the interior of lower motor 21. Upper motor 19 has a shaft 37 that extends through a central bore 39 in upper adapter 23. Shaft 37 has a splined coupling 41 on its lower end.

Figure 3:
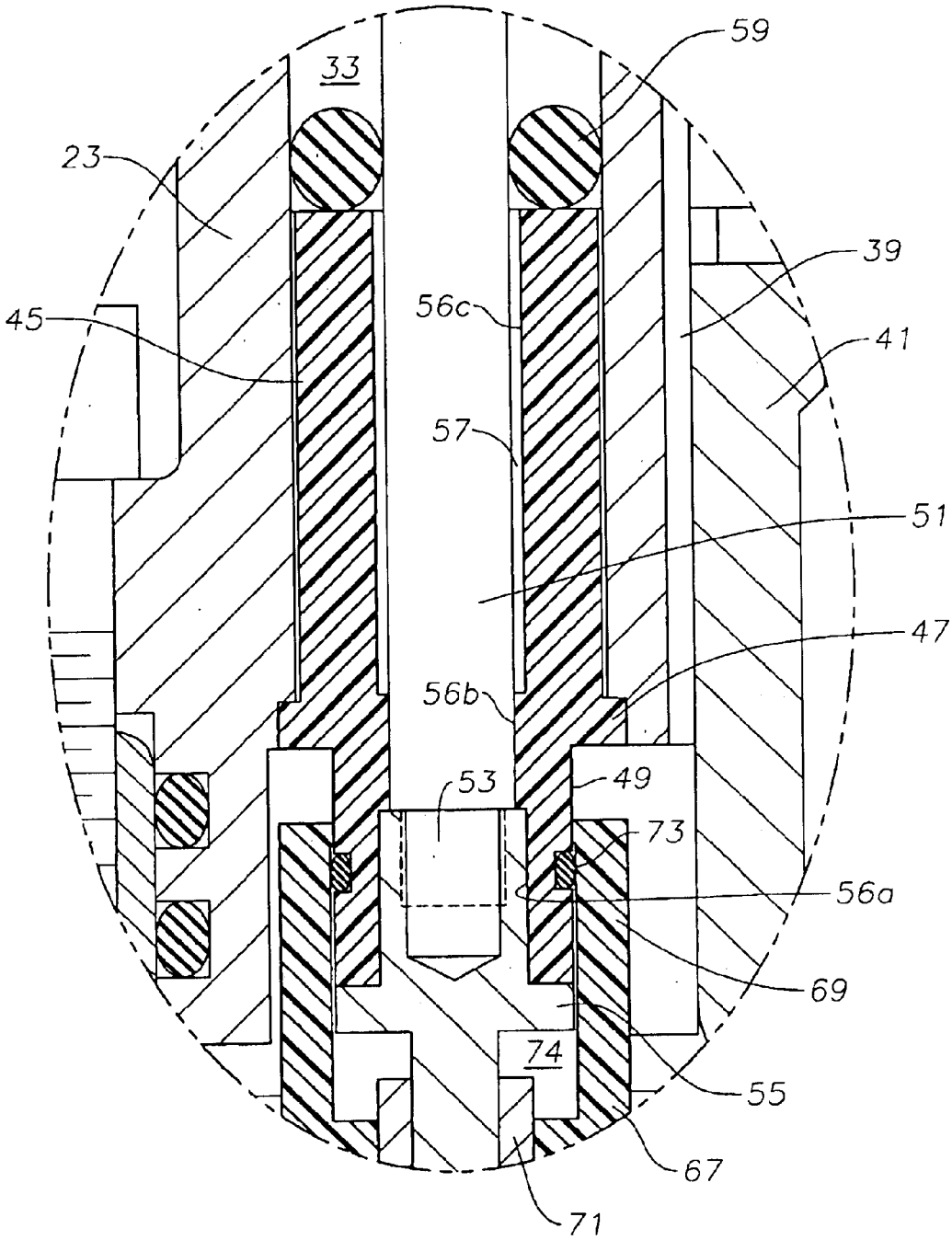
FIG. 3 is a further enlarged sectional view of one of the insulators of the upper adapter of FIG. 2.

A plurality of power wires 43 extend downward from the windings (not shown) of upper motor 19. Only one of the wires 43 is shown in FIG. 2. Wire 43 extends into an upper insulator 45 that is located at the lower end of each wire passage 33. Referring to FIG. 3, upper insulator 45 is a tubular member of rigid electrical insulation material. Insulator 45 has a flange 47 that locates in a counterbore formed at the lower end of wire passage 33. A plate (not shown) is secured by screws to the downward facing surface of upper adapter 23 to hold insulators 45 in wire passages 33. Insulator 45 has a tubular lower portion 49 that extends downward from flange 47.

Wire 43 has one or more insulation layers 51 surrounding a copper conductor 53. Conductor 53 is joined by soldering or crimping to an electrical connector 55. Electrical connector 55 has a threaded upper portion that secures to threads (not shown) within an inner diameter portion 56*a* of upper insulator 45. Inner diameter portion 56*b* of upper insulator 45 is slightly smaller and closely receives electrical insulation layer 51. Inner diameter portion 56*c*, however, is larger than inner diameter portion 56*b* and provides-an annular clearance or cavity 57 surrounding electrical insulation layer 51.

An upper debris seal 59 is located at the upper end of annular cavity 57 to prevent the migration of any metallic debris into annular cavity 57. Upper debris seal 59 is preferably an elastomeric 0-ring. Upper debris seal 59 is preferably of a material that swells when immersed in dielectric oil. While upper seal 59 could locate between inner diameter 56*c* and insulation layer 51, preferably it locates at the upper end of insulator 47. In this position, seal 59 seals between insulation layer 51 of wire 43 and the inner diameter of upper adapter wire passage 33. Although the lower side of upper debris seal 59 is shown contacting the upper end of upper insulator 45, this is not necessary because in this embodiment, upper debris seal 59 does not seal directly to upper insulator 45.

Referring again to FIG. 2, lower adapter 25 has a wire passage 61 that aligns with each of the upper wire passages 33. Lower adapter 25 also has a communication passage 62 that joins upper communication passage 35. An insulated lower wire 63 extends upward from the windings of lower motor 21 through each wire passage 61. A shaft 65 ends concentrically through lower motor 21 and has an upper end that engages splines 41.

A lower insulator 67 is located at the upper end of each wire passage 61. Lower insulator 67 is also of a rigid insulation material but differs in configuration from upper insulator 45 in this example. Lower insulator 67 has a tubular upper portion 69 (FIG. 3) that slidingly receives lower portion 49 of upper insulator 45. A lower electrical connector 71 is secured by threads in a passage in lower insulator 67. In this example, lower electrical connector 71 is a socket that receives a pin from upper electrical connector 55. The pin and socket could be reversed, however, with the socket being located above and the pin below. Also, tubular portions 49 and 69 could be reversed with portion 69 locating within portion 49.

A lower debris seal 73 is located in a groove formed on the exterior of upper insulator lower portion 49. Lower debris seal 73 is also elastomeric and preferably an O-ring. Lower debris seal 73 also is formed of a material that swells when contacted with. dielectric oil. Lower debris seal 73 seals a cavity 74 that is located within lower insulator upper portion 69, thereby blocking debris from contact with lower electrical connector 71.

Motors 19, 21 have a fill port 75, which is shown in the sidewall of lower adapter 25 in FIG. 2. Fill port 75 allows an operator to evacuate air from the interiors of motors 19, 21 and fill the motors with dielectric oil. Adapters 23, 25 are secured to each other in a conventional manner. In this example, upper adapter 23 has a flange 77 that bolts to a similar flange of lower adapter 25 by fasteners 79. Seals 81 seal the interior of upper adapter 23 to lower adapter 25.

Debris seals 59 and 73 are sized so that in an initial configuration, prior to the introduction of dielectric oil, they will not seal. That is, upper debris seal 59 will not seal to upper wire 43 or to the inner diameter of adapter wire passage 33. Similarly, lower debris seal 73 will not seal to the inner diameter of lower insulator upper portion 69. Debris seals 59, 73 are initially undersized so as to be able to evacuate and fill annular cavities 57 and 74 with lubricant.

Once assembled, the operator connects a vacuum pump to port 75 (FIG. 2) and evacuates substantially all of the air. Air will be evacuated also from annular cavities 57 and 74 because the air can flow past debris seals 59 and 73 while in their non sealing configurations. The operator then introduces dielectric oil into the interiors of motors 19, 21. The oil flows through communication passages 35, 62 and around shafts 37, 65. As shown in FIG. 2, oil will fill central bore 39 and flow past debris seal 73 into cavity 74. Also, oil in the interior of upper motor 19 flows downwardly past upper debris seal 59 into annular cavity 57.

Within a short period after immersion in dielectric fluid, debris seals 59, 73 will swell and form seals. Preferably the amount of squeeze after swelling is about 10 percent. Debris seal 59 will seal cavity 57, and debris seal 73 will seal cavity 74. During operation, the rotation of shafts 37 and 65 causes turbulence of the dielectric oil surrounding them. Metallic debris from the bushings and bearings may migrate downward around wire 43, but once reaching upper debris seal 59, will not be allowed to move any further downward. Debris may also migrate down central passage 39 around upper portion 69 of lower insulator 67. The debris, however, cannot pass between insulator portions 49, 69 because of lower debris seal 73. Lower debris seal 73 prevents debris from migrating into cavity 74.

In some cases upper motor 19 may be operated alone, without being connected to lower tandem motor 21. In that case, an end cap with a shorting plate is mounted to upper adapter 23 instead of lower adapter 25. The shorting plate electrically connects electrically connectors 55 to each other, and the end cap seals them from well fluid.

Referring again to FIG. 1, electrical receptacle 28 is not shown in detail, but may also contain a debris seal similar to debris seal 59 (FIG. 2). Electrical receptacle 28 has a rigid insulation block (not shown) with a passage for each electrical wire and each electrical connector. A debris seal optionally may be located around each insulated wire within a counterbore formed in each passage of the rigid insulation block.

The invention has significant advantages. The debris seals block metallic debris from migrating into contact with the electrical connectors. The debris seal increases the electrical leak path distance from the electrical conductor to the motor housing. The debris seals, nevertheless, allow complete filling of dielectric oil because they form seals only after being immersed in the dielectric oil.

While the invention has been shown in only one of its forms, it should be apparent to those skilled in the art that it is not so limited but susceptible to various changes without departing from the scope of the invention.

What is claimed is:

1. A motor assembly for a well pump, comprising:

a motor;

an electrical connector assembly on the motor having an insulator with a passage;

an electrical conductor having an insulation layer on its exterior and extending from the motor into the passage of the insulator;

the passage having an inner diameter that is larger than an outer diameter of the insulation layer, defining an annular cavity between the insulation layer and the inner diameter of the passage;

an electrical connector joined to the electrical conductor within the passage; and an elastomeric debris seal around the insulation layer, the debris seal having a final size in which it seals around the insulation layer and blocks entry of debris into the annular cavity, the debris seal being of a material that swells upon contact with a dielectric fluid and having an initial size in which it does not seal the annular cavity to enable the dielectric fluid to flow into the annular cavity prior to the debris seal reaching the final size.

2. The motor assembly according to claim 1, wherein the debris seal is located outside of the passage and in abutment with an end of the insulator.

3. The motor assembly according to claim 1, wherein the debris seal comprises an O-ring.

4. A motor assembly for a well pump, comprising:

an upper motor, an upper adapter on a lower end of the upper motor having at least one upper adapter passage;

an upper wire extending downward from the upper motor into the upper adapter passage;

an upper electrical connector joined to a lower end of the upper wire;

a lower motor;

a lower adapter on an upper end of the lower motor that secures to the upper adapter and has at least one lower adapter passage;

a lower wire extending upward from the lower motor into the lower adapter passage;

a lower electrical connector joined to an upper end of the lower wire for engaging the upper electrical connector;

an elastomeric upper adapter debris seal in the upper adapter passage that seals around the upper wire to prevent debris from collecting around the upper wire and the upper electrical connector in the upper adapter passage; and the upper and lower motors containing a dielectric fluid in which the electrical connectors are immersed as well as both upper and lower sides of the debris seal.

5. The motor assembly according to claim 4, wherein the upper wire has an insulation layer on its exterior, and the debris seal sealingly engages the insulation layer.

6. The motor assembly according to claim 4, wherein the debris seal comprises an annular member with an inner diameter that sealingly engages the upper wire and an outer diameter that sealingly engages an inner wall of the passage.

7. The motor assembly according to claim 4, wherein the debris seal is formed of a material that swells due to contact with the dielectric fluid from an initial position in nonsealing engagement with the upper wire to a final position in sealing engagement with the upper wire.

8. The motor assembly according to claim 4, further comprising a tubular insulator located in the upper adapter passage and surrounding the upper wire; and wherein the debris seal is located above the insulator.

9. The motor assembly according to claim 4, further comprising:

a tubular lower insulator in the lower adapter passage surrounding the lower wire and having an upper portion extending upward from the lower adapter passage;

a tubular upper insulator having an upper portion located in the upper adapter passage around the upper wire and a lower portion that inserts into overlapping engagement with the upper portion of the lower insulator; and a lower adapter debris seal located between the upper and lower portions of the insulators to prevent the entry of debris into the lower insulator.

10. The motor assembly according to claim 9, wherein the upper and lower adapter debris seals comprise O-rings.

11. The motor assembly according to claim 4, further comprising a tubular insulator in the upper adapter passage into which the upper wire extends, the upper electrical connector sealing to the insulator, defining a lower end of a sealed annular cavity, the debris seal forming an upper end of the annular cavity, the annular cavity being filled with the dielectric fluid.

12. A motor assembly for a well pump, comprising:

an upper motor, an upper adapter on a lower end of the upper motor having at least one upper adapter passage;

an upper insulator of a rigid insulating material located in the upper adapter passage and having a lower portion extending downward therefrom;

an upper wire having an insulation layer on its exterior and extending downward from the upper motor into the upper insulator;

an upper electrical connector joined to a lower end of the upper wire;

an elastomeric upper adapter debris seal that seals around the insulation layer of the wire to prevent entry of debris between the insulation layer of the wire and an inner diameter of the upper insulator;

a lower motor;

a lower adapter on an upper end of the lower motor that secures to the upper adapter and has at least one lower adapter passage;

a lower insulator of a rigid insulating material located in the lower adapter passage and having an upper portion that extends upward therefrom and engages the lower portion of the upper insulator in an overlapping relation;

a lower wire extending upward from the lower motor into the lower insulator;

a lower electrical connector joined to an upper end of the lower wire and engaging the upper electrical connector; and a lower adapter debris seal located between the lower and upper portions of the upper and lower insulators to prevent entry of debris into the lower insulator.

13. The motor assembly according to claim 12, wherein the upper adapter debris seal is located above the upper insulator and has an outer diameter that sealingly engages an inner diameter of the passage.

14. The motor assembly according to claim 12, wherein the lower portion of the upper insulator extends concentrically into the upper portion of the lower insulator.

15. The motor assembly according to claim 12, wherein the upper and lower motors contain a dielectric fluid that immerses both upper and lower sides of each of the debris seals.

16. The motor assembly according to claim 15, wherein the debris seals are formed of a material that swells when contacted with the dielectric fluid, and wherein the debris seals have an initial size prior to contact with the dielectric fluid that is nonsealing and a final size after contact with the dielectric fluid that seals.

17. The motor assembly according to claim 12, wherein the upper electrical connector seals to the upper insulator, defining a lower end of a sealed annular cavity, the upper adapter debris seal forming the upper end of the annular cavity, the upper and lower motors and the annular cavity being filled with the dielectric fluid.

18. A motor assembly for a well pump; comprising:

an upper motor;

an upper adapter on a lower end of the upper motor having at least one upper adapter passage;

an upper insulator located in the upper adapter passage and having a lower portion extending downward therefrom;

an upper wire having an insulation layer on its exterior and extending downward from the upper motor into the upper insulator;

the upper insulator having an inner diameter that is larger than an outer diameter of the insulation layer, defining an annular cavity between the insulation layer and the inner diameter of the upper insulator;

an upper electrical connector having an upper portion that extends into the annular cavity and joins to a lower end of the upper wire, the upper electrical connector blocking a lower end of the annular cavity; and an elastomeric upper adapter debris seal that has a final size in which it seals around the insulation layer of the upper wire above the upper electrical connector and blocks entry of debris into the annular cavity, the debris seal being of a material that swells upon contact with a dielectric fluid and has an having an initial size in which it does not seal the annular cavity to enable the dielectric fluid to flow into the annular cavity prior to the debris seal reaching the final size.

19. The motor assembly according to claim 18, wherein the debris seal comprises a ring that when at the final size has an inner diameter that seals to the insulation layer and an outer diameter that seals to an inner diameter of the upper adapter passage above the insulator.

20. The motor assembly according to claim 18, further comprising:

a lower motor;

a lower adapter on an upper end of the lower motor that secures to the upper adapter and has at least one lower adapter passage;

a lower insulator located in the lower adapter passage and having an upper portion that extends upward therefrom and engages the lower portion of the upper insulator in an overlapping relation;

a lower wire extending upward from the lower motor into the lower insulator;

a lower electrical connector joined to an upper end of the lower wire for engaging the upper electrical connector; and a lower adapter debris seal located between the lower and upper portions of the upper and lower insulators to prevent entry of debris into the lower insulator.

21. A method of operating a motor assembly for a well pump, comprising:

providing a motor with an electrical connector assembly that has an insulator with a passage, an electrical conductor having an insulation layer on its exterior and extending from the motor into the passage of the insulator, the passage having an inner diameter that is larger than an outer diameter of the insulation layer, defining an annular cavity between the insulation layer and the inner diameter of the passage, and an electrical connector joined to the electrical conductor within the passage;

mounting an elastomeric debris seal around the insulation layer, the debris seal having a final size in which it seals around the insulation layer and blocks entry of debris into the annular cavity, the debris seal being of a material that swells upon contact with a dielectric fluid and has an having an initial size in which it does not seal the annular cavity to enable the dielectric fluid to flow into the annular cavity prior to the debris seal reaching the final size;

placing an upper adapter debris seal around the insulation layer, the seal being of a type that swells upon contact with a dielectric fluid and has an initial size that does not seal to the wire; then drawing a vacuum on the interior of the motor and introducing a dielectric fluid into the interior of the motor, the initial size of the debris seal enabling dielectric fluid to flow past the debris seal into the annular cavity; then causing the debris seal to swell to seal around the insulation layer due to immersion in the dielectric fluid to seal the annular cavity; and supplying electrical power to the motor to cause it to operate.

* * * * *

UNITED STATES PATENT AND TRADEMARK OFFICE

CERTIFICATE OF CORRECTION

PATENT NO. : 6,780,037 B1
DATED : August 24, 2004
INVENTOR(S) : Larry J. Parmeter et al.

It is certified that error appears in the above-identified patent and that said Letters Patent is hereby corrected as shown below:

Column 1,
Line 59, delete “having an” after “has an”

Column 3,
Line 60, delete the period “.” after “with”

Column 4,
Line 42, delete “electrically” and insert -- electrical --

Column 7,
Line 35, delete “has an” before “having an”

Signed and Sealed this

First Day of February, 2005

JON W. DUDAS
*Director of the United States Patent and Trademark Office*